United States Patent [19]

Kadison et al.

[11] 4,004,051

[45] Jan. 18, 1977

[54] AQUEOUS NOBLE METAL SUSPENSIONS FOR ONE STAGE ACTIVATION OF NONCONDUCTORS FOR ELECTROLESS PLATING

[75] Inventors: Leon A. Kadison; Eileen Maguire, both of Pasadena, Calif.

[73] Assignee: Crown City Plating Company, El Monte, Calif.

[22] Filed: Feb. 10, 1975

[21] Appl. No.: 548,539

Related U.S. Application Data

[63] Continuation-in-part of Ser. No. 443,082, Feb. 15, 1974, abandoned.

[52] U.S. Cl. ..... 427/304; 427/305; 427/306; 106/1; 106/287 R

[51] Int. Cl.[2] ..... C23C 3/02

[58] Field of Search ..... 427/304, 305, 306; 106/1, 287 R

[56] References Cited

UNITED STATES PATENTS

| | | | |
|---|---|---|---|
| 3,011,920 | 12/1961 | Shipley | 106/1 X |
| 3,438,440 | 4/1969 | Richardson | 427/305 X |
| 3,500,927 | 3/1970 | Simpson | 427/305 X |
| 3,627,558 | 12/1971 | Roger et al. | 427/305 |
| 3,682,671 | 8/1972 | Zeblisky | 106/286 |
| 3,698,939 | 10/1972 | Leaman | 106/1 X |

*Primary Examiner*—Ralph S. Kendall
*Attorney, Agent, or Firm*—Christie, Parker & Hale

[57] ABSTRACT

An aqueous noble metal suspension capable of one stage activation of the surface of a nonconductor for electroless plating is provided by reducing a noble metal ion in an aqueous solution of a noble metal salt with a non-complexing reducing agent for the noble metal ion in the presence of a water soluble organic suspending agent.

The particulate noble metal is rapidly absorbed by a nonconducting surface over a broad range of operating temperatures when the suspension is maintained at a pH below 3.5.

52 Claims, No Drawings

AQUEOUS NOBLE METAL SUSPENSIONS FOR ONE STAGE ACTIVATION OF NONCONDUCTORS FOR ELECTROLESS PLATING

CROSS REFERENCE TO RELATED APPLICATIONS

This is a continuation-in-part of our application Ser. No. 443,082 filed Feb. 15, 1974, now abandoned.

BACKGROUND OF THE INVENTION

The present invention relates to the activation of a normally nonconductive surface to the electroless plating.

Electroless plating involves the spontaneous chemical reduction and deposition of a metal onto a normally non-conductive surface, such as a polymeric surface activated by provided free noble metal sites. The deposited metal coating acts as a buss to allow a thicker metal coating to be built up electrolytically.

On a commercial scale, an electroless plating operation consists of a number of batch-wise stages in series through which articles to be electrolessly plated are passed with one or more rinse operations occurring between each stage to minimize "drag in" of chemicals from one stage into the next. Although residence time will vary from stage to stage, the cycle time for transport apparatus require a degree of coordination of residence times as between the several stages involved. This is necessary to make the operation economical without sacrificing the quality of the electrolessly deposited plate.

The most common substrates plated are articles molded from organic polymers such as acrylonitrile-butadiene-styrene resins. For organic polymers, the first stage typically involves an organic or mechanical deglazing of the article surface. This is followed by etching in a strong oxidizing acid, such as chromic acid or mixtures of chromic and sulfuric acid. The most uniform acid etch is that described in our U.S. Pat. No. 3,366,130 issued June 6, 1972.

The function of the etch operations are to form minute sites for the deposition of a noble metal without destroying the integrity of the polymeric surface.

As indicated, between each stage there is performed one or more rinse operations. They are employed to remove from the articles to be plated, as well as the racks on which they are typically contained, any material "dragged out" from a previous bath to prevent "drag in" into a subsequent bath. "Drag in" can cause contamination of the subsequent bath or, in some instances, decomposition of the subsequent bath. Decomposition can occur in the surface activation bath and/or the electroless plating bath.

As indicated, surface activation involves the formation of noble metal sites on the surface of the article to be electrolessly plated. The noble metal most typically used is palladium.

The prior methods of depositing a noble metal involve two distinct stages aside from any rinse operations which may be employed. One method involves contacting the article with a sensitizing solution containing stannous chloride, followed by immersion in an activator solution such as palladium chloride where $Pd^{++}$ is reduced to $Pd^{\circ}$ on the surface of the article.

While useful, the greatest disadvantage of this method of activating a surface for electroless plating is the phenomenon known as "skip plating". Skip plating is the result of unequal absorption or reduction leaving inactive areas or areas less active than others at which an electroless plate will not be deposited. Because of "skip plating", article rejection or recycle rate is high.

Another employs a highly acidic solution of a noble metal colloid, typically a palladium colloid, maintained in suspension by a protective colloid, i.e. stannic acid colloids. Activating solutions of this nature are described in U.S. Pat. No. 3,011,920 to Charles R. Shipley, Jr.

In their preparation, a stannous salt, such as stannous chloride is added in an amount greatly in excess of that required to reduce $Pd^{++}$ to $Pd^{\circ}$ to contemporaneously form the protective colloid.

Colloidal palladium formed by other reductants and protected by other protective colloids under alkaline conditions are also mentioned. They are, however, stated to be less effective than the acidic colloids and, as presently known, have not been used to any extent on a commercial scale.

Because the colloidal palladium as well as the protective colloid are co-absorbed by the substrate to be electrolessly plated, the article is immersed in an acidic or alkaline accelerator solution to remove the protective colloid and expose the absorbed noble metal.

The acceleration step can be eliminated if the electroless plating solution is highly alkaline in nature and capable of removing the protective colloid. This route, however, is not commercially feasible since prolonged immersion times, i.e. 15–20 minutes, are required before electroless plating begins. This method, therefore, also requires, in substance, two stage activation.

While the use of an activator solution based on a colloidal noble metal suspended by a protective metal represents a significant improvement over the two stage activation operation previously discussed, it also has several drawbacks.

To prepare a functional solution involves a number of complex and time consuming chemical reactions. These chemical reactions are evidenced by a number of color changes, and may take several weeks to go to completion. Heating to temperatures as high as boiling for a period of time can accelerate the reactions.

The resultant activator solutions are also sensitive to both temperature and pH. Elevated temperature can result in decomposition of the bath with attendant precipitation of the noble metal. Because of this, a "growth factor" must be coped with to account for the "drag in" of materials from a previous bath or rinse which tends to dilute the bath. As a result, as chemicals are consumed, a portion of the bath must be periodically discarded and makeup chemicals added over and above the amount of chemicals utilized in activating the surfaces of substrates for electroless plating.

Independent of this, the use of an activator solution of this nature also requires the loss of a considerable quantity of the metal employed as the protective colloid. When colloidal palladium is protected by a stannic acid colloid, for instance, the excess tin required for the protective colloid is lost in the accelerator solution and eventually discarded as waste.

SUMMARY OF THE INVENTION

According to the present invention there is provided a one stage noble metal suspension for the activation of substrates for electroless plating. The suspensions are, in most instances, rendered active upon admixture of the required chemicals and will be rapidly absorbed by the surface of an article to be electrolessly plated over a wide range of operating temperatures, when maintained at a pH below about 3.5. Acceleration is not required to achieve surface activation.

The activator suspensions, of this invention, are formed by the addition of a non-complexing reducing agent for the noble metal ions to an aqueous solution containing at least one dissolved noble metal salt and an organic suspending agent capable of preventing free noble metal particles from condensing to a size too great to prevent surface absorption and which do not form an absorbed hindering protective colloid. The non-complexing reducing agent is added in an amount sufficient to form a quantity of suspended free noble metal particles at a concentration which renders the suspension, at the required pH, capable of directly activating the surface of an immersed substrate for electroless plating. The amount of non-complexing reducing agent added is generally up to the stoichiometric amount required to reduce the dissolved noble metal ions to the free metal state. Excessive amounts, however, should be avoided, as they can cause the formation of particles of a size greater than that which will pass through conventional filters.

A variety of materials have been found to reduce the noble metal ions to the free noble metal state with dimethylamine borane and sodium borohydride being preferred. Reduction of the noble metal ion may be carried out under acidic or alkaline conditions with acidic conditions preferred. When reduction is carried out at a solution pH above 3.5, the solution is acidulated to reduce pH to 3.5 or less, preferably less than about 2.0.

As indicated, reduction of the noble metal ion occurs in the presence of a water soluble, organic suspending agent. The preferred suspending agents are the polymerized alkyl napthalene sulfonic acid and its salts, particularly the sodium and potassium salts.

Although not essential to the formation of the suspension, pH control is necessary to achieve surface activation. The acids added may be organic or inorganic in nature with organic acids, particularly oxalic acid being preferred. Oxalic acid has been found to cope with hexavalent chromium ions introduced as "drag in" by reduction to trivalent chromium ions. Mixtures of acids can, of course, be employed.

The activator solutions are typically prepared by first dissolving a noble metal salt in water to form a solution which is acidic or basic in nature depending on the reducing agent employed. The water soluble, organic dispersing agent is then added followed by the addition of the non-complexing reducing agent with agitation. Where reduction occurs under alkaline conditions or when the net suspension is above 3.5, acid is added to reduce pH to a level required for surface activation.

In general, the activator suspensions contain the reduced noble metal in an amount from 0.0002 to about 0.14 mol per liter, suspending agent in an amount from about 0.25 to about 100 grams per liter, acid in an amount from about 0.2 to about 100 grams per liter, the balance being water and the oxidized residue of the reducing agent. Preferably, the non-complexing reducing agent is added in an amount sufficient to reduce all of the noble metal ions to the free metal state.

A typical suspension is based on the reduction of palladium chloride to free palladium as prepared by the dissolving of 0.2 gram of palladium chloride per liter in water then adding up to 36 grams of oxalic acid per liter for pH control. Six grams per liter of the sodium salt of polymerized alkyl napthalene sulfonic acid is then added as the suspending agent followed by 0.1 gram per liter dimethylamine borane to reduce $Pd^{++}$ to $Pd^{\circ}$. The balance of the formed suspension is water.

When desired, water soluble or miscible polyethylene glycols may be added as stabilizers.

In employing the activator suspensions of this invention, the article to be electrolessly plated is immersed in the activator suspension for a time sufficient for the contained free noble metal to be absorbed from the suspension onto the surface of the article. Residence time will generally vary widely and preferably from about 1 to about 3 minutes or more, at temperatures ranging from ambient to about 140° F, preferably from about 100° to about 140° F.

Activation at elevated temperatures increases absorption rate and provides the unique feature of the ability to evaporate a portion of the water from the suspension during use to account for water introduced from previous rinse operation(s), and to permit the addition of makeup chemicals, as chemicals are consumed without creating a problem of volume growth.

The most important feature, however, is that the activator suspensions of this invention do not require immersion in accelerator solutions in order to expose the absorbed noble metal to permit electroless plating. As compared to prior art colloidal solutions, they are truly one step activators which eliminate at least one bath in an electroless plating operation, chemical losses and reduce the time required to achieve electroless plating of substrates.

DETAILED DESCRIPTION

There is provided in accordance with the present invention one stage activator suspensions which render, upon immersion, a nonconductive surface active for the electroless deposition of metals, such as copper, nickle, cobalt and the like.

The activator suspensions are prepared by the addition of one or more non-complexing reducing agent(s) to a solution of one or more noble metal ions in the presence of one or more water soluble organic suspending agent(s) for the formed free noble metal particles. The reducing agent is added in an amount sufficient to form free noble metal particles in a concentration which renders the suspension, at the required pH of about 3.5 or less, capable of activating the surface of an immersed nonconductive substrate for the spontaneous reduction and plating of metals electrolessly.

As indicated, to enable absorption by a nonconducting surface requires that the activator suspensions of this invention be maintained at a pH below about 3.5, preferably below about 2, as rate of absorption of the dispersed free particulate metals is enhanced by reduced pH.

While functional at ambient temperatures, activation is preferably at a temperature from about 100 to about 140° F, as elevated temperatures enhance the rate of absorption. Mechanical and/or air agitation can be conveniently employed.

The activator suspensions provided in accordance with the invention, are prepared by dissolving one or more noble metal salt, such as palladium chloride, in water followed by the addition of a water soluble dispersing agent. Typically, the noble metal salts are dissolved in an acid solution.

The amount of acid added may be only that required to enhance solution of the noble metal salt(s) up to that required to achieve a net pH at which the activator suspension is used.

There is then added the desired amount of non-complexing reducing agent or agents with agitation followed by, if necessary, the remainder of the acid required to reduce pH to a level at which the suspension will be absorbed on the surface of nonconductors.

While any noble metal salt may be used to form the activator suspensions of this invention including among others the salts of gold, palladium and platinum, palladium salts are typically preferred, and ensuing discussion will be primarily directed to them.

Independent of the amount of noble metal salts dissolved, the amount of reducing agent added is at least that required to provide sufficient free noble metal particles dispersed by the organic dispersing agent to achieve surface activation. The preferred reduced noble metal concentration is from about 0.0002 to about 0.14 mol per liter in order that absorption of the metal particles onto the surface of a substrate will be rapid and uniform.

To make maximum utilization of the dissolved noble metal salts present, the amount of reducing agent added is approximately that stoichiometrically required to reduce the dissolved metal ions to the free metal state. Excessive amounts, however, should be avoided as they tend to override the action of the organic dispersing agent causing condensation of metal particles to a size greater than that which will pass through filters normally employed in the activator baths of an electroless plating operation. Preferably, the precautions taken should be to limit the particle size of the formed free particulate noble metals to a size less than about 0.2 micron. Many of the reducing agents decompose in the suspension within a relatively short period of time, and a certain excess can be tolerated without causing particle condensation.

As it is unnecessary to add a reducing agent beyond that required to reduce a dissolved noble metal ion to the free noble metal state, it is evident that the reducing agent in the suspensions of this invention, do not act as protective colloids, for the formed free noble metal particles.

While not bound by the theory, the suspensions of this invention contain suspended free noble metal particles, formed by the condensation of smaller particles of the noble metals, resulting from their reduction, into larger ones which are prevented by the suspending agent from condensing into particles of a size which will not be absorbed onto the surface of a substrate to be electrolessly plated. They are distinguished from dispersions which result from the breakdown of larger particles into smaller particles.

They are also distinguished from prior art colloidal noble metal solutions which require a protective colloid for the colloidal noble metals. In the prior art colloidal solutions, the protective colloid is co-absorbed by the substrate to be electrolessly plated and must be removed by contact with an accelerator to expose the free noble metal before electroless plating can be initiated.

Reduction of the noble metal ion to the free noble metal salt is accomplished by the addition of a non-complexing reducing agent. By this there is meant a reducing agent which will not form complexes with the partially reduced noble metal ions at an intermediate valence state to hinder their complete reduction to the free metal state.

Compounds which are preferably used as non-complexing reducing agents include among others dimethylamine borane, sodium borohydride, ascorbic acid, titanium trichloride, sodium hypophosphite, hydrazine anhydride and the like, with dimethylamine borane and sodium borohydride being particularly preferred. Reduction may be accomplished under acidic or alkaline conditions.

Formic acid and formaldehyde may also be used, but require heating to initiate the reduction reactions. However, once the reduction reactions are initiated, the noble metal ion is reduced to a state at which it is active without requiring contact with an accelerator solution.

As indicated, the noble metal ions may be reduced under alkaline conditions. In this instance, after dissolving the noble metal salt, alkaline conditions are created by the addition of a base and reduction accomplished using the reducing agent employed. The formed suspension, however, does not become active for absorption until the suspension is reduced to a pH of 3.5 or less by acid addition. Because of this, reduction under alkaline conditions is the least desired, except for the formation of an initial bath to which acidic reducing agents are subsequently added with other makeup chemicals to maintain the activator solution in the acidic state. A mixture of non-complexing reducing agents, of course, may be employed.

The water soluble, organic suspensing agents are compounds capable of preventing the free particulate noble metal from condensing into particles of a size too great to achieve surface activation or pass through filters, and which do not form coabsorbed protective colloids that require the use of an accelerator to expose the absorbed noble metals to render a surface active for electroless plating. The presently preferred suspending agents are the polymerized alkyl napthalene sulfonic acids and their salts, particularly the sodium and potassium salts.

Polysorbate momo-oleate, polyvinyl alcohol as well as gelatin have also been found to be functional. Gelatin, however, is the least preferred, as it tends to form an occluding deposit on the surface of the substrate during activation requiring a hot rinse to dissolve off the deposited coat.

The amount of suspending agent added is only that required to maintain the suspension and will generally range from about 0.25 to about 100 grams per liter.

It is beneficial to include with the suspending agent or agents a water soluble or miscible polyethylene glycol. The preferred polyethylene glycols have an average molecular weight of from about 400 to about 1000, more preferably about 600. In general, end use concentration should be from about 0.25 to 30 grams per liter. While not acting as suspending agents in themselves, the polyethylene glycols supplement the suspending agents by retarding gradual setting of particles during the protected period of standing, especially when suspensions are formed as a concentrate for subsequent dilution prior to use.

In order to make a formed suspension capable of being absorbed onto a surface of a nonconductor to achieve surface activation, requires the presence or addition of an acid. Inorganic acids, such as hydrochloric acid may be used, but should be avoided as they tend to oxidize a reduced metal back to the ionic state.

This requires the addition of the non-complexing reducing agents to combat the dissolving action of the acid.

It is, therefore, more preferred to use an organic acid which has minimum tendency to reoxidize the reduced noble metal. The preferred organic acids are toluene sulfonic acid, sulfamic acid, gluconic acid, glycolic acid, formic acid and oxalic acid. Oxalic, formic and glycolic acids are preferred, as they will cope with hexavalent chromium introduced as "drag in" from the etch solution and will reduce it to an inert trivalent state. Oxalic acid is particularly preferred, as it will also chelate palladium ion prior to reduction to control reduction and has minimal solubilizing effect upon the reduced metal sol.

Formic acid, when used, serves the dual function of controlling pH and acting as a reducing agent.

While no wise limiting, the formed activator suspension of the present invention will generally contain from about 0,0002 to about 0.14 mol per liter of the particulate reduced free noble metal ion, from about 0.25 to about 100 grams per liter of the suspending agent and from 0.2 to about 100 grams per liter of a selected acid to maintain pH at a level of 3.5 or less, preferably 2.0 or less. The particulate, free noble metal is formed from the corresponding salt by the addition or formation of a reducing agent in an amount sufficient to provide an activated suspension, and preferably a stoichiometric amount. The balance of the solution is water.

A presently preferred suspension is based on palladium chloride and involves the reduction of palladium chloride contained in a solution in a concentration of about 0.2 gram per liter. The suspending agent is an alkali metal salt of a polymerized alkyl napthalene sulfonic acid and present in an amount of about 6 grams per liter. Oxalic acid for pH control is present in an amount of 36 grams per liter. The reducing agent is dimethylamine borane and added in an amount of 0.1 gram per liter.

This suspension is formed by dissolving the palladium chloride in water acidified with 0.2 g/l of oxalic acid. The alkali salt of the polyermized alkyl napthalene sulfonic acid is then added. Dimethylamine borane is dissolved in water and added to the mixture with agitation, followed by the addition of the balance of the oxalic acid. The net suspension has a pH of about 1.5 to 1.7.

Although functional for the surface activation of any suitable substrate, the use of the noble metal suspensions of this invention will be described with reference to the activation of polymeric substrates. After etching with an oxidizing acid such as chromic acid or mixtures of chromic and sulfuric acids, the articles are rinsed, neutralized to remove, to the extent possible, any residual acid then rinsed again. The articles are then immersed in the activator suspension. Depending on the temperatures employed, immersion times may be as low as about 30 seconds and up to as long as desired. For most instances, immersion times of from about 1 to 3 minutes are employed. Although ambient temperatures may be employed, it is preferred that the temperature be from about 100° to about 140° F. as elevated temperatures have been found to minimize immersion time.

Elevated temperatures are also preferably employed to evaporate the water introduced from previous rinse operations and account for excess water resulting from consumption of chemicals so that there will not be created a "growth" factor. This permits makeup chemicals to be added without removing and discarding a portion of the activator solution.

Following immersion of the article to be electrolessly plated in the activator solution, the articles are then water rinsed and immersed in an electroless plating solution. Typical are those based on copper and nickle. Copper solutions are normally used and a typical aqueous composition is given below.

| Ingredient | Molar Concentration |
|---|---|
| Soluble Cupric Salt | 0.02–0.15 |
| Complexing Agent | 0.03–0.75 |
| Reducing Agent | 0.05–1.50 |
| pH Adjustor | Sufficient to give a pH from 11 to 14 |

Solutions are usually stabilized to prevent spontaneous decomposition.

As indicated, the activator suspensions of this invention are used for direct surface activation without the need for contact with accelerator solutions.

Using palladium for example, the palladium will reduce to form a suspension dark brown to black in shade with a surface activation being indicated by a light brown deposit on the surface of a substrate of contrasting shade.

In contrast, where stannous chloride is substituted for the non-complexing reducing agents in an equivalent amount, there results an unstable suspension which does not deposit a visible coating on a nonconductive substrate of contrasting shade. Even immersion in an accelerator solution to remove protective colloids will not render the surface active for electroless plating. This is believed due to the formation of a palladium-tin complex.

While no wise limiting, the following Examples are illustrative of the practice of the present invention.

EXAMPLES 1 to 24

In the following examples, an activator suspension was prepared by first dissolving palladium chloride in water under acid conditions followed by the desired amount of the dispersing agent. The reducing agent was then added with stirring and, if necessary, the balance of the acid. Each activator solution was evaluated by immersion of chromic acid etched articles of acrylonitrile-butadiene-styrene into the activator suspension maintained at 130° F for times varying from 1 to 3 minutes. The plaques were removed, rinsed in water, and electrolessly plated by immersion in stabilized electroless copper plating solution known as Cuposit™ PM-990 manufactured and sold by the Shipley Company.

The activator solutions formulated, remarks pertinent to each are shown in Table 1. For each instance, amounts shown are for ingredients added to form a liter of suspension, the balance being water. Ratings are as follows:

1. Capable of depositing sufficient palladium to achieve a uniform plate of copper from the electroless plating solution in less than about 45 seconds.

2. Capable of depositing sufficient palladium to achieve a uniform plate of copper from the electroless plating solution in less than about 90 seconds.

3. Capable of depositing sufficient palladium to achieve a uniform plate of copper from the electroless plating solution is less than about 360 seconds.

Table I

| Ex. | $PdCl_2$, g | Dispersing Agent | Amount | Acid | Amount | Reducing Agent | Amount | pH | Rating |
|---|---|---|---|---|---|---|---|---|---|
| 1 | 0.2 | Daxad[a] | 1 g | Oxalic | 6 g | dimethylamine borane | 0.1 g | 1.7 | 2 |
| 2 | " | " | " | " | " | $NaBH_2$ | 0.08 g | — | 2 |
| 3 | " | " | " | " | " | $NaH_2PO_4$ | 0.4 g | 1.65 | 2 |
| 4 | " | " | 100 | " | 36 g | dimethylamine borane | 0.05 g | 1.5–1.7 | 1 |
| 5 | " | " | 6 g | " | " | " | " | — | 1 |
| 6 | " | " | 1 g | " | 6 g | $TiCl_3$ | 1.6 g | — | 2 |
| 7 | " | polysorbate mono-oleate | 2.0 g | " | " | ascorbic acid | 0.008 g | — | 2 |
| 8 | " | " | " | " | " | formic acid | 0.08 c.c. | — | 2[b] |
| 9 | " | " | " | " | " | formaldehyde | 6 c.c. | — | 2[b] |
| 10 | " | " | " | " | " | $TiCl_3$ | 1.6 g | — | 2 |
| 11 | " | polyvinyl alcohol | 0.2 g | " | " | dimethylamine borane | 0.025 g | — | 2 |
| 12 | " | gelatin | 1 g | " | " | " | " | — | 3 |
| 13 | " | Daxad[a] | 2 g | Sulfamic | 12 g | " | 0.1 g | 1.55 | 2 |
| 14 | " | " | " | Toluene Sulfonic | 12 g | " | " | 1.55 | 2 |
| 15 | " | " | " | HCl | 4.5 c.c. | " | 0.05 g | 1.22 | 2 |
| 16 | " | " | 10 g | Gluconic | 12.5 g | " | " | 2.5 | 2 at 130° F |
| 17 | " | " | 2 g | Oxalic | 6 g | " | 1.1 g | 1.38 | 2 |
| 18 | 1.25 gr | " | 11 g | Oxalic<br>Gluconic | 30 g<br>50 g | " | 0.25 g | 1.15 | 2 |
| 19 | 0.2 gr | " | 4 g | Citric | 12 g | " | 0.1 g | 2.14 | 3 (required heating) |
| 20 | 0.25 g | " | 1 g | Oxalic<br>Formic | 6 g<br>20 c.c. | " | 0.025 g | 1.44 | 2 |
| 21 | " | " | " | Oxalic<br>Gluconic | 6 g<br>10 g | " | " | 1.43 | 2 |
| 22 | " | " | " | Oxalic<br>Gluconic<br>Formic | 6 g<br>10 g<br>20 c.c. | " | " | 1.42 | 2 |
| 23 | 0.20 g | " | 6 g | Glycolic (70%) | 41 c.c. | " | 0.05 g | — | 2 |
| 24 | " | " | 100 | Oxalic | 6 g | " | " | 1.74 | 2 |

[a]A sodium salt of a polymerized alkyl naphthalene sulfonic acid manufacture and sold by the Dewey and Almey Division of W. R. Grace & Co. and known as Daxad 11.
[b]Required heating to initiate reduction of $Pd^{++}$ to Pd°.

EXAMPLE 25

Repeating the procedure of Examples 1 to 24, to an alkaline aqueous solution containing 0.2 grams per liter dissolved palladium chloride, there was added 1 gram of the sodium salt of a polymerized alkyl naphthalene sulfonic acid and 0.4 cc of hydrazine to reduce the palladium ions to free palladium. The resultant suspension had a pH of 8.8, and was not absorbed by the etched plaque in that a copper deposit was not formed upon immersion into the electroless copper plating solution. When oxalic acid was added in an amount to reduce pH to 3.5, absorption occurred and a copper plate was deposited. When pH was reduced to 1.63 by addition of more oxalic acid a rating of 1 was determined.

EXAMPLE 26

A suspension was prepared based on the reduction of 0.2 g/l $PdCl_2$; 36 g/l oxalic acid, 6 g/l of the sodium salt of polymerized alkyl napthalene sulfonic acid, and 0.1 g/l of dimethylamine borane as the reducing agent. The resultant suspension was found to have a pH of about 1.7 and active with respect to activation of gray ABS resin plaques over a temperature range from 100° to 130° F in that a visible brown coating of absorbed Pd° was observed after immersion times ranging from 1.5 to 3 minutes. Complete coverage with copper following immersion in an electroless copper plating solution as described for Examples 1 to 24 was obtained within 45 to 60 seconds.

EXAMPLE 27

A suspension was prepared based on the initial mixing of 0.2 g/l Pd $Cl_2$; 0.2 g/l oxalic acid, 6 g/l of Daxad 11 and 2 g/l of Pluracol 600 a polyethylene glycol manufactured and sold by Wyandotte Chemicals Corporation and 0.05 g/l of dimetnylamine borane in which there was added 32 g/l oxalic acid. The resultant suspension was used to activate ABS plaques. The visible brown coating of absorbed Pd° was observed within immersion times of 1.5 to 3 minutes. Complete coverage with copper following immersion in an electroless copper plating solution as described for Examples 1 to 24 was obtained within 45 to 60 seconds.

CONTROL A

Example 26 was repeated except that oxalic acid concentration was reduced to 0.2 g/l and 2.3 g/l stannous chloride was used in place of dimethylamine borane. There was formed a reddish-brown suspension having pH about 3 which precipitated in time. The precipitate had a beige color. Over the temperature range described in Example 26, no visible absorption of palladium from the suspension onto plaque was observed even after 9 minutes immersion and surface was non-catalytic to copper deposition after immersion for 10 minutes. The same results were obtained even after the plaques were immersed in a 10% soda ash solution, used as an accelerator, prior to immersion in the electroless copper plating solution.

CONTROL B

Control A was repeated except that oxalic acid concentration was increased to about 6 g/l to reduce pH to 1.7. The same results as described in Control A were obtained.

CONTROL C

Control A was repeated except that oxalic acid was increased to 36 g/l and pH was 1.65. The same results as set forth in Control A were obtained.

CONTROL D

Controls A, B and C were repeated except that stannous chloride was first dissolved in methanol. The same results as set forth in Control A were obtained.

CONTROL E

Control D was repeated except that stannous chloride concentration was increased to 30 g/l. The same results as set forth in Control A were obtained and a "muddy" suspension was formed along with the precipitate.

CONTROL F

A formulation was prepared based on 0.2 g/l $PdCl_2$, 6 g/l of the sodium salt of a polymerized alkyl napthalene sulfonic acid, 4.5 cc of HCl and 2.3 g/l of stannous chloride. The same results as described in Control A were obtained in that the suspension was non-activating with respect to the plaques.

What is claimed is:

1. An activator suspension for the one stage surface activation of a nonconductive surface for electroless plating which comprises an acidic aqueous suspension of absorbable particles of at least on noble metal formed by the reduction of the corresponding noble metal ion to the free metal state by at least one reducing agent for said noble metal ion which is other than a stannous salt and is noncomplexing with respect to the noble metal ion in the presence of at least one water soluble, organic suspending agent capable of preventing condensation of reduced free noble metal particles without the formation of an absorbable protective colloid and selected from a group consisting of a polymerized alkyl napthalene sulfonic acid, salts of a polymerized alkyl napthalene sulfonic acid, salts of a polymerized alkyl napthalene sulfonic acid and mixtures thereof, the free noble metal particles in said suspension being absorbable onto the surface of a nonconductive substrate when said suspension is at a pH below about 3.5.

2. An activator suspension as claimed in claim 1, in which the free noble metal content is from about 0.0002 to about 0.14 mol per liter of suspension.

3. An activator suspension as claimed in claim 2 in which the noble metal is palladium.

4. An activator suspension as claimed in claim 1 in which the water soluble, organic suspending agent is present in an amount of from about 0.25 to about 100 grams per liter.

5. An activator suspension as claimed in claim 1 in which the non-complexing reducing agent is selected from the group consisting of dimethylamine borane, sodium borohydride, ascorbic acid, titanium trichloride, formic acid, formaldehyde, hydrazine anhydride, sodium hypophosphite and mixtures thereof.

6. An activator suspension as claimed in claim 1 in which the suspension is maintained at a pH of less than about 3.5 by the presence of an acid selected from the group consisting of oxalic acid, toluene sulfonic acid, sulfamic acid, gluconic acid, glycolic acid, formic acid, hydrochloric acid, and mixtures thereof.

7. An activator suspension as claimed in claim 6 in which the suspension is maintained at a pH less than about 2.0.

8. An activator suspension as claimed i claim 1 in which there is dissolved in the suspension a polyethylene glycol.

9. An activator suspension as claimed in claim 8 in which the polyethylene glycol has an average molecular weight of from about 400 to about 1000 and is present in a concentration of from about 0.25 to about 30 grams per liter.

10. An activator suspension for the one stage surface activation of a nonconductive surface for electroless plating which comprises an acidic aqueous suspension of particles of at least one noble metal present in an amount of from about 0.0002 to about 0.14 mol per liter, a water soluble, organic suspending agent capable of preventing condensation of reduced free noble metal particles without the formation of an absorbable protective colloid and selected from the group consisting of a polymerized alkyl napthalene sulfonic acid, salts of a polymerized alkyl napthalene sulfonic acid and mixtures thereof in an amount of from about 0.25 to about 100 grams per liter, and about 0.2 to about 100 grams per liter of an acid to maintain the pH of the suspension less than about 3.5, said suspension being formed by the reduction of a noble metal ion in the presence of the water soluble, organic suspending agent by the addition of a reducing agent for the noble metal ion which reducing agent is not a stannous salt and is not noncomplexing with respect to the noble metal ion.

11. An activator suspension as claimed in claim 10 in which the non-complexing reducing agent is added in an amount up to the stoichiometric amount of reducing agent required to reduce the noble metal ion.

12. An activator suspension as claimed in claim 10 in which the non-complexing reducing agent is selected from the group consisting of dimethylamine borane, sodium borohydride, ascorbic acid, titanium trichloride, formic acid, formaldehyde, hydrazine anhydride, sodium hypophosphite and mixtures thereof.

13. An activator suspension as claimed in claim 10 in which the acid is selected from the group consisting of oxalic acid, formic acid, glycolic acid and mixtures thereof.

14. An activator suspension as claimed in claim 10 in which there is dissolved in the suspension a polyethylene glycol.

15. An activator suspension as claimed in claim 14 in which the polyethylene glycol has an average molecular weight of from about 400 to about 1000 and is present in a concentration of from about 0.25 to about 30 grams per liter.

16. A process for the surface activation of nonconductive substrates for electroless plating which comprises immersing the article in an aqueous suspension maintained at a pH less than about 3.5 and containing absorbable particles of at least one noble metal formed by the reduction of corresponding noble metal ions with a reducing agent for said noble metal ions which reducing agent is a nonstannous salt as is noncomplexing with respect to the noble metal ion in the presence of a water soluble, organic suspending agent capable of preventing condensation of reduced free noble metal particles without the formation of an absorbable protective colloid and selected from the group consisting of polymerized alkyl napthalene sulfonic acid, salts of a polymerized alkyl napthalene sulfonic acid and mixtures thereof for a time sufficient to form an absorbed coating of noble metal particles on the surface of the substrate to be electrolessly plated.

17. A process as claimed in claim 16 in which immersion time is for about 1 to about 3 minutes.

18. A process as claimed in claim 16 in which the suspension is maintained at a temperature from ambient to about 140° F.

19. A process as claimed in claim 17 in which the suspension is maintained at a temperature from ambient to about 140° F.

20. A process as claimed in claim 16 in which the suspension is maintained at a temperature from about 100 to about 140° F.

21. A process as claimed in claim 17 in which the suspension is maintained at a temperature from about 100 to about 140° F.

22. A process as claimed in claim 16 in which the suspension is maintained at a pH less than about 2.

23. A process as claimed in claim 18 in which the suspension is maintained at a pH less than about 2.

24. A process as claimed in claim 20 in which the suspension is maintained at a pH less than about 2.

25. A process as claimed in claim 1 in which a polyethylene glycol is dissolved in the suspension.

26. A process as claimed in claim 25 in which the polyethylene glycol has an average molecular weight from about 400 to about 1000 and is present in a concentration of from about 0.25 to about 30 grams per liter.

27. An activator suspension for the one stage surface activation of a nonconductive surface for electroless plating which comprises an acidic aqueous suspension of absorbable particles of at least one noble metal formed by the reduction of the corresponding noble metal ion to the free metal state by at least one noncomplexing reducing agent for said noble metal ion which is other than a stannous salt and is noncomplexing with respect to the noble metal ion in the presence of at least one water soluble, organic suspending agent capable of preventing condensation of reduced free noble metal particles without the formation of an absorbable protective colloid and selected from the group consisting of polysorbate mono-oleate, polyvinyl chloride and mixtures thereof, the free noble metal particles in said suspension being absorbable onto the surface of a nonconductive substrate when said suspension is at a pH below about 3.5.

28. An activator suspension as claimed in claim 27 in which the free noble metal content is from about 0.0002 to about 0.14 mol per liter of suspension.

29. An activator suspension as claimed in claim 28 in which the noble metal is palladium.

30. An activator suspension as claimed in claim 27 in which the water soluble, organic suspending agent is present in an amount of from about 0.25 to about 100 grams per liter.

31. An activator suspension as claimed in claim 27 in which the noncomplexing reducing agent is selected from the group consisting of dimethylamine borane, sodium borohydride, ascorbic acid, titanium trichloride, formic acid, formaldehyde, hydrazine anhydride, sodium hypophosphite and mixtures thereof.

32. An activator suspension as claimed in claim 27 in which the suspension is maintained at a pH of less than about 3.5 by the presence of an acid selected from the group consisting of oxalic acid, toluene sulfonic acid, sulfamic acid, gluconic acid, glycolic acid, formic acid, hydrochloric acid, and mixtures thereof.

33. An activator suspension as claimed in claim 32 in which the suspension is maintained at a pH less than about 2.0.

34. An activator suspension as claimed in claim 27 in which there is dissolved in the suspension a polyethylene glycol.

35. An activator suspension as claimed in claim 34 in which the polyethylene glycol has an average molecular weight of from about 400 to about 1000 and is present in a concentration of from about 0.25 to about 30 grams per liter.

36. An activator suspension for the one stage surface activation of a nonconductive surface for electroless plating which comprises an acidic aqueous suspension of particles of at least one noble metal present in an amount of from about 0.0002 to about 0.14 mol per liter, a water soluble, organic suspending agent selected from the group consisting of polysorbate mono-oleate, polyvinyl chloride and mixtures thereof capable of preventing condensation of reduced free noble metal particles without the formation of an absorbable protective colloid in an amount of from about 0.25 to about 100 grams per liter, and about 0.2 to about 100 grams per liter of an acid to maintain the pH of the suspension less than about 3.5, said suspension being formed by the reduction of a noble metal ion in the presence of the water soluble, organic suspending agent by the addition of a reducing agent for the noble metal ion which reducing agent is a nonstannous salt and is noncomplexing with respect to the noble metal ion.

37. An activator suspension as claimed in claim 36 in which the noncomplexing reducing agent is added in an amount up to the stoichiometric amount of reducing agent required to reduce the noble metal ion.

38. An activator suspension as claimed in claim 36 in which the noncomplexing reducing agent is selected from the group consisting of dimethyalmine borane, sodium borohydride, ascorbic acid, titanium trichloride, formic acid, formaldehyde, hydrazine anhydride, sodium hypophosphite and mixtures thereof.

39. An activator suspension as claimed in claim 36 in which the acid is selected from the group consisting of oxalic acid, formic acid, glycolic acid and mixtures thereof.

40. An activator suspension as claimed in claim 36 in which there is dissolved in the suspension a polyethylene glycol.

41. An activator suspension as claimed in claim 40 in which the polyethylene glycol has an average molecular weight of from about 400 to about 1000 and is present in a concentration of from about 0.25 to about 30 grams per liter.

42. A process for the surface activation of nonconductive substrates for electroless plating which comprises immersing the article in an aqueous suspension maintained at a pH less than about 3.5 and containing absorbable particles of at least one noble metal formed by the reduction of corresponding noble metal ions with a reducing agent for said noble metal ions which reducing agent is a nonstannous salt and noncomplexing with respect to the noble metal ions in the presence of a water soluble, organic suspending agent capable of preventing condensation of reduced free noble metal particles without the formation of an absorbable protective colloid and selected from the group consisting of polysorbate mono-oleate, polyvinyl chloride and mixtures thereof for a time sufficient to form an absorbed coating of noble metal particles on the surface of the substrate to be electrolessly plated.

43. A process as claimed in claim 42 in which immersion time is for about 1 to about 3 minutes.

44. A process as claimed in claim 42 in which the suspension is maintained at a temperature from ambient to about 140° F.

45. A process as claimed in claim 37 in which the suspension is maintained at a temperature from ambient to about 140° F.

46. A process as claimed in claim 42 in which the suspension is maintained at a temperature from about 100 to about 140° F.

47. A process as claimed in claim 43 in which the suspension is maintained at a temperature from about 100 to about 140° F.

48. A process as claimed in claim 42 in which the suspension is maintained at a pH less than about 2.

49. A process as claimed in claim 44 in which the suspension is maintained at a pH less than about 2.

50. A process as claimed in claim 46 in which the suspension is maintained at a pH less than about 2.

51. A process as claimed in claim 36 in which a polyethylene glycol is dissolved in the suspension.

52. A process as claimed in claim 51 in which the polyethylene glycol has an average molecular weight from about 400 to about 1000 and is present in a concentration of from about 0.25 to about 30 grams per liter.

* * * * *

UNITED STATES PATENT AND TRADEMARK OFFICE

CERTIFICATE OF CORRECTION

PATENT NO. : 4,004,051

DATED : January 18, 1977

INVENTOR(S) : Leon A. Kadison and Eileen Maguire

It is certified that error appears in the above-identified patent and that said Letters Patent are hereby corrected as shown below:

Column 6, line 42, "momo-oleate" should read --mono-oleate--.

Column 10, line 45, "dimetnylamine" should read --dimethylamine--.

Column 11, line 48, "ized alkyl napthalene sulfonic acid, salts of a polymer-" should be eliminated.

Column 12, line 10, "i" should read --in--.

Signed and Sealed this

Fourteenth Day of June 1977

[SEAL]

*Attest:*

RUTH C. MASON
*Attesting Officer*

C. MARSHALL DANN
*Commissioner of Patents and Trademarks*